US007331398B2

(12) United States Patent
Dwivedi et al.

(10) Patent No.: US 7,331,398 B2
(45) Date of Patent: Feb. 19, 2008

(54) MULTI-DROP FLOW CONTROL VALVE SYSTEM

(75) Inventors: Alok Dwivedi, Houston, TX (US); Stephen Parks, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 247 days.

(21) Appl. No.: 11/160,219

(22) Filed: Jun. 14, 2005

(65) Prior Publication Data

US 2006/0278399 A1 Dec. 14, 2006

(51) Int. Cl.
*E21B 34/10* (2006.01)
*F01L 3/10* (2006.01)

(52) U.S. Cl. ..... 166/375; 166/386; 166/321; 166/313; 251/337; 137/628

(58) Field of Classification Search ..... 166/321, 166/375, 386, 320, 319, 191, 313, 188, 183, 166/185, 186, 334.1, 306; 251/336, 337; 137/628, 627.5, 630.16, 630
See application file for complete search history.

(56) References Cited

U.S. PATENT DOCUMENTS 2,894,715 A * 7/1959 Bostock ..... 251/58
3,830,297 A * 8/1974 Cockrell ..... 166/322
4,942,926 A * 7/1990 Lessi ..... 166/385
5,547,029 A * 8/1996 Rubbo et al. ..... 166/375
5,832,996 A 11/1998 Carmody et al.
6,012,518 A 1/2000 Pringle et al.
6,109,357 A 8/2000 Zimmerman
6,125,938 A 10/2000 Garcia-Soule et al.
6,237,683 B1 5/2001 Pringle et al.
6,308,783 B2 10/2001 Pringle et al.
6,523,613 B2 2/2003 Rayssiguier et al.
6,575,237 B2 6/2003 Purkis et al.
6,612,547 B2 9/2003 Carmody et al.
6,668,936 B2 12/2003 Williamson, Jr. et al.
6,691,786 B2 2/2004 Patel
6,722,439 B2 4/2004 Garay et al.
6,736,213 B2 5/2004 Bussear et al.
2004/0069491 A1 4/2004 Garay et al.
2005/0263279 A1 * 12/2005 Vachon ..... 166/250.01
2006/0162935 A1 * 7/2006 MacDougall ..... 166/375

FOREIGN PATENT DOCUMENTS

WO WO00/04274 A1 1/2000

* cited by examiner

*Primary Examiner*—Kenneth Thompson
(74) *Attorney, Agent, or Firm*—Henry L. Ehrlich; Bryan P. Galloway; Dona C. Edwards

(57) ABSTRACT

A multi-drop flow control valve system having a plurality of hydraulically actuated flow control valve, each valve set in an initial operating position. The flow control valves are connected to a hydraulic control line in sequence, wherein the second flow control valve is below the first flow control valve and so on. Wherein a first hydraulic pressure in the control line will operate at least the first flow control valve to an actuated position and a second hydraulic pressure greater than the first hydraulic pressure will operate at least the first and second flow control valves to actuated positions. It may be desired for each of the control valves to be biased in the initial position when the hydraulic pressure is less than a base pressure.

24 Claims, 4 Drawing Sheets

TO 28b
10
18a
22
26
28a
30
32
34
36
38
40
42
44
46
48

MULTI-DROP FLOW CONTROL VALVE SYSTEM

FIELD OF THE INVENTION

The present invention relates in general to a system for controlling the flow of fluid radially to and from a string of tubing at multiple locations. More particularly, the invention relates to a system for controlling via a single control line the radial flow of fluid to and from a string of tubing at multiple locations.

BACKGROUND

In completing a well, one or more zones may be perforated to enable production and/or injection of fluids. Completion equipment including flow control devices, tubing, packers, and other devices may be installed in various positions in the well to manage the respective zones. In operating the well it is necessary to actuate the flow control device for each zone.

Typically each flow control device is actuated hydraulically, electrically, mechanically or pneumatically via a separate control line routed to each flow control device. For example, a well having four productions zones, each managed by a single hydraulically operated flow control valve, would require four separate hydraulic control lines. The multiplicity of control lines required heretofore adversely affects cost, reliability, and wellbore diameter.

Therefore, it is a desire to provide a system for controlling multiple hydraulically actuated flow control devices via a single hydraulic control line.

SUMMARY OF THE INVENTION

In view of the foregoing and other considerations, the present invention relates to controlling flow control devices through a single hydraulic line.

Accordingly, an embodiment of a flow control system includes a first hydraulically actuated flow control valve, set in an initial operating position, connected to a control line and a routing valve connected between the control line and the first flow control valve, the routing valve operationally set at a first routing pressure; and a second hydraulically actuated flow control valve connected to the control line sequentially below the first hydraulically actuated flow control valve, the second hydraulically control valve being set in an initial operating position and a routing valve connected between the control line and the second flow control valve, the routing valve operationally set at a second routing pressure.

Wherein a hydraulic pressure in the control line less than the first routing pressure will operate the first flow control valve to an actuated position, a hydraulic pressure equal to or greater than the first routing pressure will operate the first valve to a subsequent actuated position and operate the second flow control valve to an actuated position and a hydraulic pressure equal to or greater than the second routing pressure will operate the second flow control valve to a subsequent actuated position.

A multi-drop flow control valve system of another embodiment may include a first hydraulically actuated flow control valve connected to the control line, the first flow control valve set in an initial operating position and a second hydraulically actuated flow control valve sequentially connected to the control line, the second hydraulically actuated flow control valve set in an initial operating position.

Wherein a first hydraulic pressure in the control line will operate the first and the second flow control valves to an actuated position and a second hydraulic pressure greater than the first hydraulic pressure will operate the first and the second flow control valves to subsequent actuated positions.

The initial position may be either an open, closed, or a choke position. In the open position an aperture in the tubular housing is uncovered by the choke permitting radial flow to and from the tubing via the valve. In the closed position, the aperture through the housing is covered preventing radial flow, and in the choked position the choke partially covers the aperture through the housing. The choke may be a slidable sleeve having an orifice for alignment with the aperture through the housing to facilitate radial flow.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
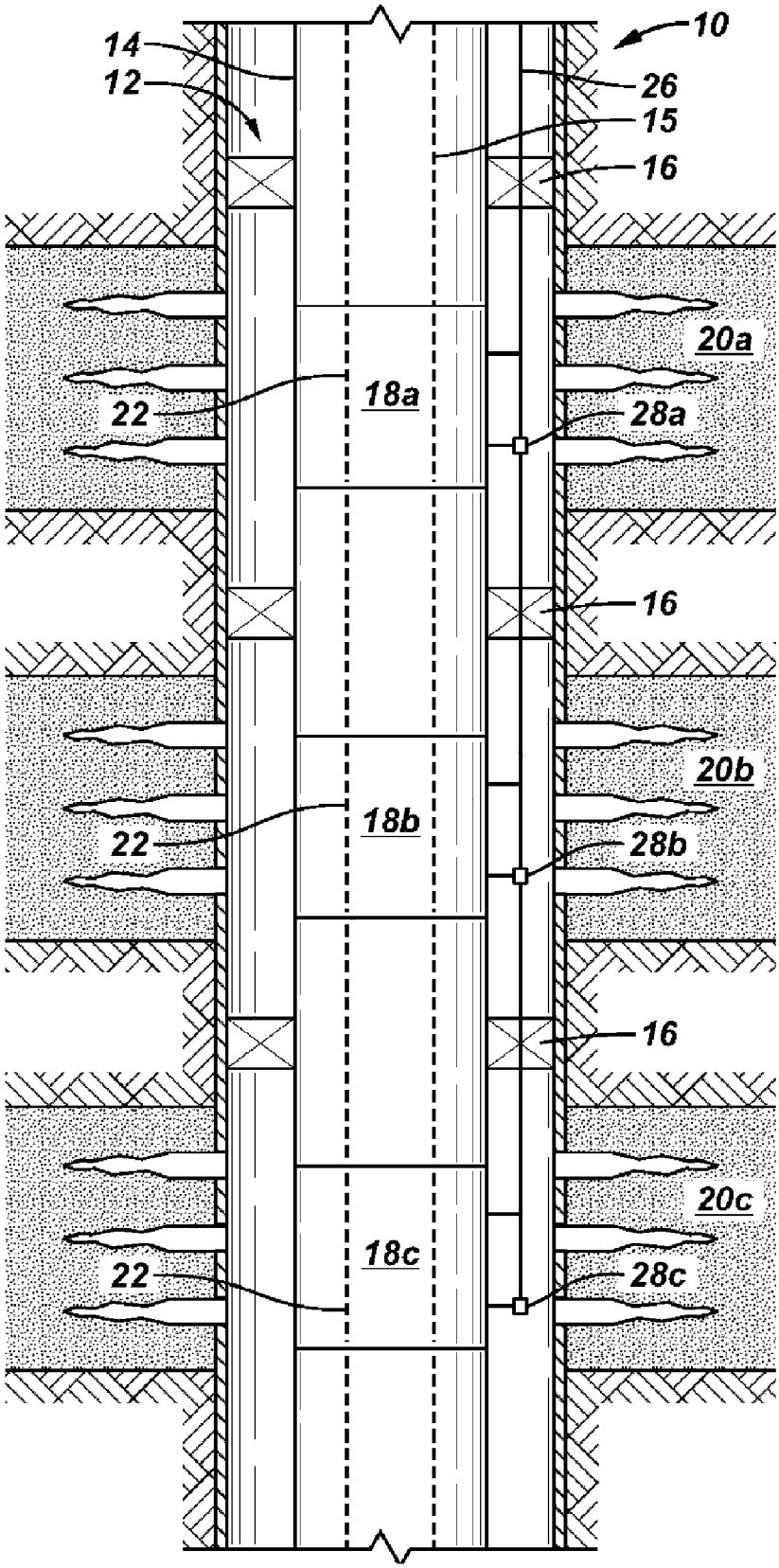
FIG. 1 is a schematic view of an embodiment of the present invention.

Refer now to the drawings wherein depicted elements are not necessarily shown to scale and wherein like or similar elements are designated by the same reference numeral through the several views.

As used herein, the terms "up" and "down"; "upper" and "lower"; "upstream" and "downstream" and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic view of a single control line, multi-drop flow control valve system, generally denoted by the numeral 10, in accordance to one embodiment of the present invention positioned in a wellbore 12. The completion string includes a tubing 14 having a bore 15 (e.g., a production tubing or other type of tubing or pipe), a packer 16, and a plurality of flow control valves 18*a*, 18*b*, 18*c*, generally referred to as 18, each positioned proximate a formation zone 20*a*, 20*b*, 20*c*, generally referred to as 20. Each flow control valve includes an internal bore 22 co-axially aligned with tubing bore 15. Wellbore 12 may be lined with a casing 24. The term "tubing" as used herein has a general meaning and includes pipes, annular regions, mandrels, conduits, or any structure including a passageway through which fluid can flow.

All of the flow control valves 18 are hydraulically actuated and functionally connected in series to a single control line 26. Control line 26 is connected to a fluid and power source, not shown, as is well known in the art. A routing valve 28*a*, 28*b*, 28*c* is in operational connection between control line 26 and each respective flow control valve 18*a*, 18*b*, 18*c*. FIG. 1 illustrates a well utilizing a system having three production zones, however, it should be recognized that this embodiment of the invention may incorporate one or more fluid flow control valves 18. Although the various Figures disclose the flow of fluid being radially between the tubing bore 15 and the exterior of the tubing 14, it should be recognized that "fluid flow control valve" may include various valves and valve installations through which fluid flows.

Figures 2A, 2B, 2C:
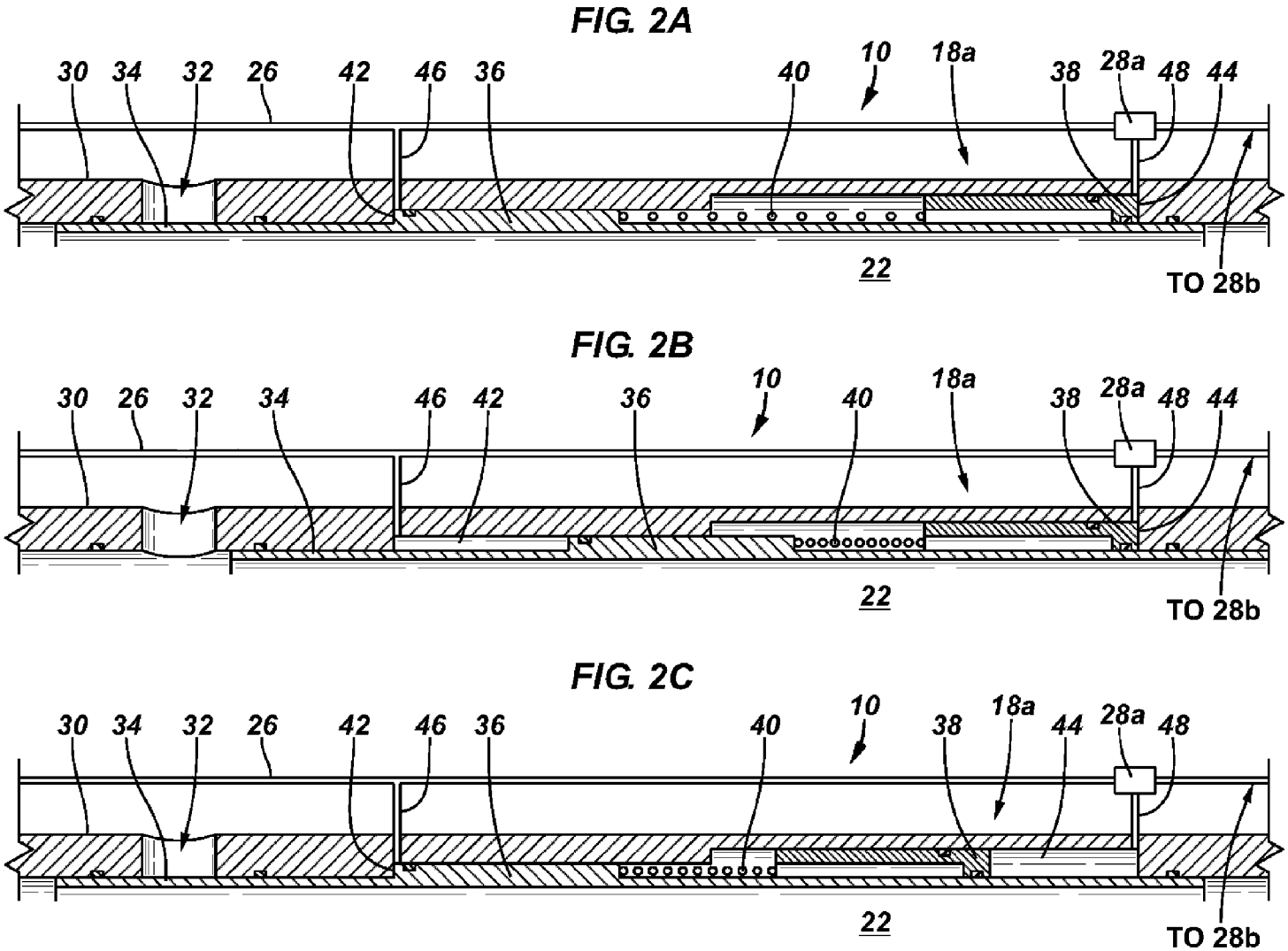
FIG. 2A is a cross-sectional view of the valve of FIG. 1 shown in the initial position.
FIG. 2B is a cross-sectional view of the valve of FIG. 1 in an actuated position.
FIG. 2C is a cross-sectional view of a flow control valve of FIG. 1 in a subsequent actuated position.

FIGS. 2A-2C are partial, cross-section views of flow control valve 18*a*, representative of all of the flow control valves 18 shown in various operational positions. Flow control valve 18*a* of the present embodiment is a hydraulically actuated, double-piston valve. Hydraulic pressure is used to actuate the valve between the closed and the open position. Valve 18*a* includes a housing 30 having an aperture 32 formed therethrough and a choke 34. Valve housing 30 may form a plurality of apertures 32 around its circumference. Choke 34 is movable between a closed position wherein choke 34 blocks fluid flow through aperture 32 and an open position wherein aperture 32 is uncovered and the valve is open. In the illustrations choke 34 is shown as an internal sliding sleeve, however, it should be recognized that various configurations are adapted for the present invention, such as, but not limited to external sliding sleeves and discs.

Valve 18*a* includes two pistons, a first piston 36 and a second piston 38, in moving connection with sliding sleeve 34. A biasing mechanism 40 is disposed between first piston 36 and second piston 38. Biasing mechanism 40 is illustrated as a spring. A first hydraulic chamber 42 is formed by housing 30 in communication with first piston 36. A second hydraulic chamber 44 is formed by housing 30 in communication with second piston 38. First hydraulic chamber 42 is connected to control line 26 via a first hydraulic conduit 46. Second hydraulic chamber 44 is connected to control line 26 through a second hydraulic conduit 48 via routing valve 28*a*.

FIG. 2A illustrates flow control valve 18*a* in its initial position, shown as the closed position. In the initial position the hydraulic pressure is substantially zero. Biasing mechanism 40 is set to a valve base pressure to counter the hydrostatic head at valve 18*a* in the wellbore, thereby maintaining flow control valve 18*a* in the initial position when the hydraulic pressure is below the valve set pressure. Biasing mechanism 40 provides a fail-initial position, wherein if hydraulic pressure is lost the valve will fail to the valve's initial position.

FIG. 2B illustrates flow control valve 18*a* in an actuated position, shown as open. Flow control valve 18*a* is operated to the actuated position by applying a first hydraulic pressure (P1) in control line 26 greater than the valve set pressure to act on first piston 36, compressing biasing mechanism 40 and moving sleeve 34 from blocking aperture 32. Routing valve 28*a* is preset at a routing pressure (P2) such that when the pressure in control line 26 is lower than P2, fluid flow through routing valve 28*a* is blocked.

FIG. 2C illustrates flow control valve 18*a* in an subsequent actuated position, which is the actuated closed position in this example. When the pressure in control line 26 is stepped-up to the valve routing pressure (P2), routing valve 28*a* opens allowing fluid flow to second hydraulic chamber 44 acting on second piston 38 thereby biasing sleeve 34 to a blocking position of aperture 32. Piston 38 has a greater cross-sectional area than piston 36 to facilitate movement of biasing sleeve 34 to the blocking position. Hydraulic pressure may then be utilized to actuate the next flow control valve 18*b*.

With reference to FIGS. 1-2C, the actuation of sequential flow control valves 18*b*, 18*c*, etc. continues in the same manner. For each control valve the biasing mechanism is set to counter the base pressure for that valve position and the respective routing valve is set at a routing pressure greater than the preceding flow control valve's routing pressure. For example, routing valve 28*b* is set at a routing pressure P4. When the hydraulic pressure is greater than P2 and less than P4 the hydraulic fluid flows through routing valve 28*a* to actuate valve 18*b* to the actuated position (FIG. 2B), valve 18*a* is actuated to the subsequent actuated position (FIG. 2C) and valve 18*c* remains in its initial position (FIG. 2A). When the hydraulic pressure reaches the second valve routing pressure P4, valves 18*a* and 18*b* are actuated to the closed position (FIG. 2C) and valve 18*c* is moved to the actuated open position (FIG. 2B). The operation of successive valves continues in the same manner. Again, if the hydraulic pressure drops below the set base pressure of any flow control valve 18, that valve will move to its initial position, the closed position in the illustrated examples. The operational steps for system 10 include setting the flow control valves at an initial position, stepping the pressure up to operate a first valve to an actuated position, stepping the pressure up to operate the first valve to a subsequent actuated position and operate a second valve to an actuated position, stepping the pressure up to operate the second valve to a subsequent actuated position. Once again the initial position may be open or closed, or in a choked flow position.

Figure 3:
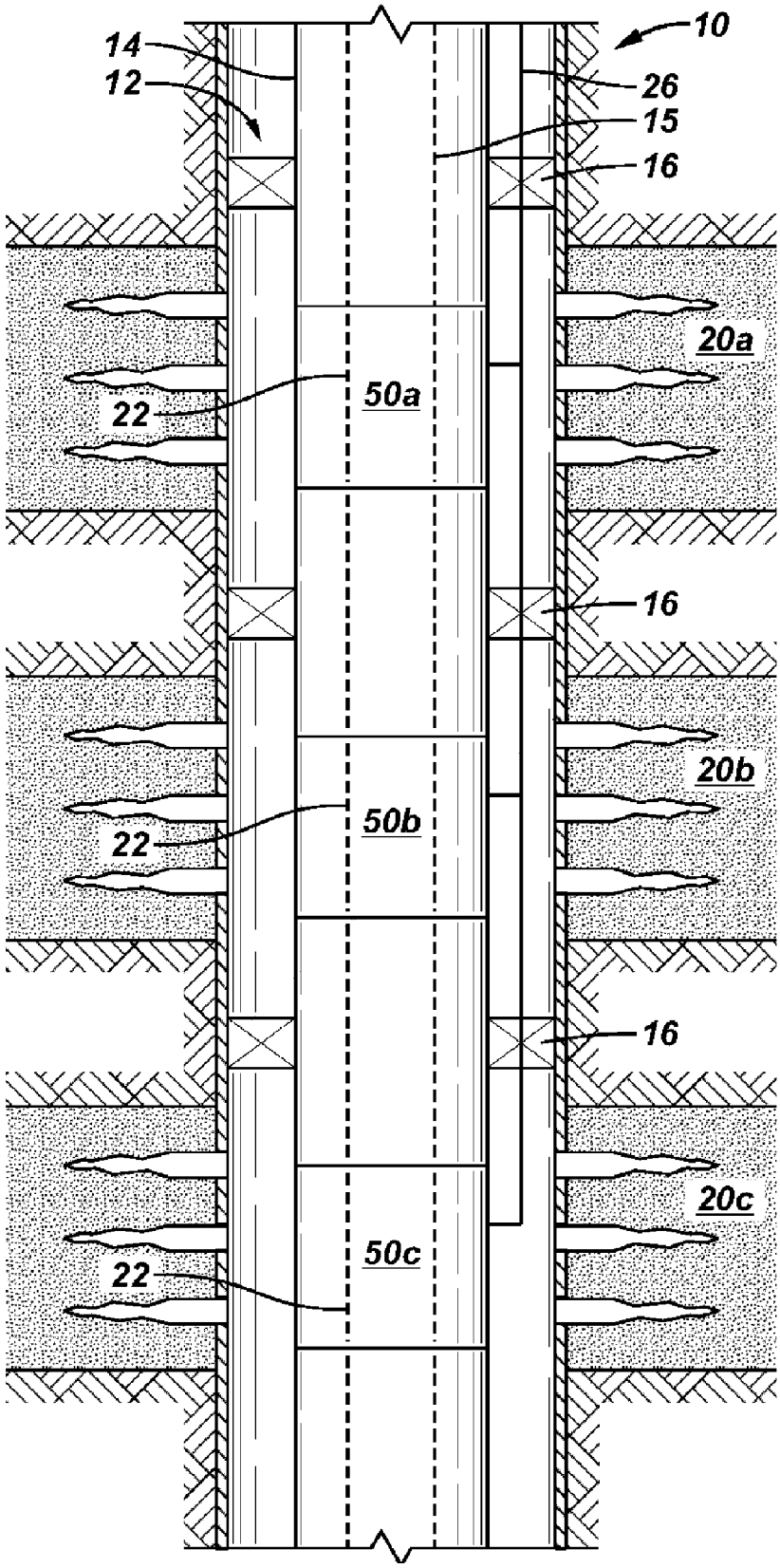
FIG. 3 is a schematic view of another embodiment of the present invention.

FIG. 3 is a schematic view of a single control line, multi-drop flow control valve system, generally designated by the numeral 10, of another embodiment of the present invention positioned in a wellbore 12. The completion string includes a tubing 14 having a bore 15 (e.g., a production tubing or other type of tubing or pipe), a packer 16, and a plurality of flow control valves 50*a*, 50*b*, 50*c* each positioned proximate a formation zone 20*a*, 20*b*, 20*c*. Each flow control valve includes an internal bore 22 co-axially aligned with tubing bore 15. Wellbore 12 may be lined with a casing 24. The term "tubing" as used herein has a general meaning and includes pipes, annular regions, mandrels, conduits, or any structure including a passageway through which fluid can flow.

All of the flow control valves 50 are hydraulically actuated and functionally connected sequentially to a single control line 26. Control line 26 is connected to a fluid and power source, not shown, as is well known in the art.

FIG. 3 illustrates a well utilizing a system having three production zones, however, it should be recognized that this embodiment of the invention may incorporate more than three fluid flow control valves 50. It should further be recognized that "fluid flow control valve" may include various valves and valve installations through which fluid flows, although the various Figures disclose the flow of fluid being radially between the tubing bore 15 and exterior of the tubing 14.

Figure 4A:
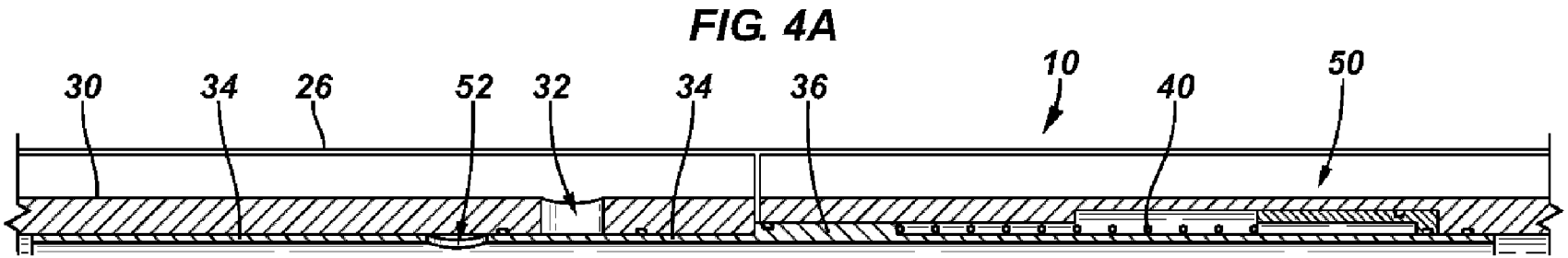
FIG. 4A is a cross-sectional view of a flow control valve of FIG. 3 shown in the initial position.
Figure 4B:
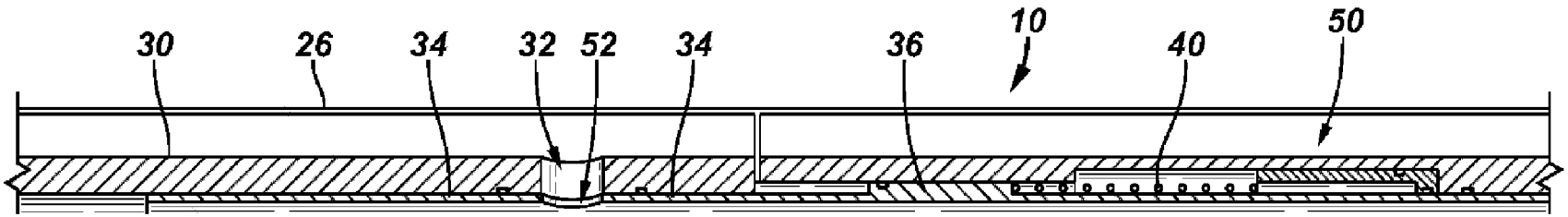
FIG. 4B is a cross-sectional view of a flow control valve of FIG. 3 shown in an actuated position.
Figure 4C:
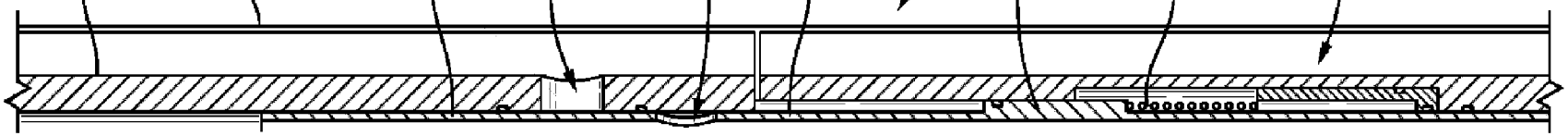
FIG. 4C is a cross-sectional view of a flow control valve of FIG. 3 shown in a subsequent actuated position.

FIG. 4A-4C are partial, cross-section views of a flow control valve 50 shown in various operational positions. Hydraulic pressure is used to actuate the valve. Valve 50 includes a housing 30 having an aperture 32 formed therethrough for fluid to flow and a choke 34. Valve housing 30 may form a plurality of apertures 32 around its circumference. Choke 34, shown as a sliding sleeve, having an orifice 52 is moveable between an open position wherein orifice 52 is aligned with aperture 32 and a closed position wherein sleeve 34 blocks flow through aperture 32, and positions there between for controlling the fluid flow rate. Apertures 34 and orifices 52 may take any shape or configuration. It should further be recognized that when valve 50 is in the "open" position, aperture 32 may be fully uncovered or partially covered. In the illustrations sliding sleeve 34 is shown as an internal sliding sleeve, however, it should be recognized that various configurations are adapted and contemplated by the present invention.

Flow control valve 50 includes a first piston 36 in moving connection with sliding sleeve 34 and a biasing mechanism 40. Biasing mechanism 40 is illustrated as a spring, although it should be recognized that other biasing mechanism may be utilized, such as a second hydraulic chamber or additional hydraulic line. Biasing mechanism 50 is set to a base pressure to counter the hydrostatic pressure at the position of valve 50 in the wellbore.

FIG. 4A is a partial, cross-sectional illustration of a flow control valve 50 in its initial position, illustrated as the closed position. In the initial position the hydraulic pressure in control line 26 is substantially equivalent to the hydrostatic pressure of control line 26. Biasing mechanism 40 is set at the base pressure urging piston 36 and sleeve 34 in the initial position until the hydraulic pressure in control line 26 exceeds the valve's set base pressure.

FIG. 4B illustrates flow control valve 50 operated to the actuated position, illustrated as the open position. A first hydraulic pressure greater than the valve's base pressure is applied through control line 26 moving choke 34 to a position such that orifice 52 is aligned with aperture 32 opening valve 50. It should be recognized that the actuated position may be the same as the initial position depending on the location of orifice 52 on choke 34 and the stroke of choke 34.

FIG. 4C illustrates flow control valve 50 operated to a subsequent actuated position, illustrated as the closed position. Valve 50 is placed in the subsequent actuated closed position by applying a second hydraulic pressure greater than the first hydraulic pressure for valve 50 urging choke 34 to a position blocking fluid flow through aperture 32. Again, if the hydraulic pressure in control line 26 is released choke 34 will return to the initial position (FIG. 4A).

With reference to FIGS. 3-4C the operation of system 10 of FIG. 3 is described. Flow control valves 50, represented by 50*a*, 50*b*, 50*c* are disposed within wellbore 12. Each of the flow control valves 50 is sequentially connected to hydraulic control line 26. Biasing mechanism 40 for each flow control valve 50*a*, 50*b*and 50*c* is set to a base pressure to overcome the hydrostatic head for the setting depth of that valve so that the hydrostatic head does not operate the valves. The stroke of each choke 34 is the same for each of the flow control valves 50. However, flow orifice 52 for each of the flow control valves is spaced differently along the stroke of each of the chokes such that each valve operates at its own pre-selected interval.

The initial, actuated, and subsequent actuated positions are set for each flow control valve individually. For example, the initial position for valves 50*a*, 50*b*, and 50*c* respectively may be open, close, open; close, close, open; close, open, close, open, open, close; all closed, or all opened. In the same manner the actuated and subsequent actuated positions may be selected so that each of the valves 50 may be selectively controlled. As illustrated in the Figures, when no hydraulic pressure is applied, each flow control valve 50 is in the default closed position. When a first hydraulic pressure is applied in control line 26 the choke 34 for each flow control valves 50*a*, 50*b* and 50*c* moves. At this first hydraulic pressure one of the valves, for example valve 50*a*, is placed in the actuated open position and valves 50*b* and 50*c* remain closed, although the choke stroked. When the hydraulic pressure is at a second pressure greater than the first hydraulic pressure, flow control valve 50*a* is in the subsequent actuated closed position (FIG. 4C), flow control valve 50*b* is in the actuated open position (FIG. 4B) and flow control valve 50*c* is in the subsequent closed position (FIG. 4A). If hydraulic pressure in control line is lost each of the flow control valves would be in the initial closed position (FIG. 4A).

From the foregoing detailed description of specific embodiments of the invention, it should be apparent that a system for controlling multiple hydraulic flow control valves via a single hydraulic control line that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. For example, openings, apertures and orifices may take various sizes and shapes; "open" may include allowing full or restricted flow through an opening; biasing means may include mechanical springs, pressurized mechanisms and the like; and the choke may include other blocking mechanisms known in the art, such as, but not limited to sliding sleeves and discs.

What is claimed is:

1. A method of controlling multiple flow control valves with a single hydraulic control line, the method comprising the steps of:

providing a first hydraulically actuated flow control valve set in an initial operational position;

providing at least a second hydraulically actuated flow control valve set in an initial operational position;

connecting the first and the second flow control valves sequentially to a hydraulic control line;

applying a first hydraulic pressure to the control line operating the first flow control valve to an actuated position; and applying a second hydraulic pressure greater than the first hydraulic pressure to the control line operating the first flow control valve to a subsequent actuated position and operating the second flow control valve to its actuated position.

2. The method of claim 1, further including the steps of:

setting a valve base pressure for the first flow control valve, wherein the first flow control device is in its initial position when the hydraulic pressure in the control line is below the first valve's base pressure; and setting a valve base pressure for the second flow control valve, wherein the second flow control device is operated to its initial position when the hydraulic pressure in the control line is below the second valve's base pressure.

3. The method of claim 1, further including the steps of:

setting a valve routing pressure for the first flow control valve wherein the hydraulic pressure in the control line must be equal to or greater than the first flow control valve's routing pressure to operate the first flow control valve from its actuated position to its subsequent actuated position, and to operate the second flow control valve from its initial position to its actuated position; and setting a valve routing pressure for the second flow control valve wherein the hydraulic pressure in the control line must be greater than the routing pressure for the second flow control valve to operate the second flow control valve from its actuated position to a subsequent actuated position.

4. The method of claim 3, further including the steps of:

setting a valve base pressure for the first flow control valve, wherein the first flow control device is in its initial position when the hydraulic pressure in the control line is below the first valve's base pressure; and setting a valve base pressure for the second flow control valve, wherein the second flow control device is in the initial position when the hydraulic pressure in the control line is below the second valve's base pressure.

5. The method of claim 3, wherein:

the first hydraulic pressure is less than the routing pressure of the first control valve; and the second hydraulic pressure is equal to or greater than the routing pressure of the first flow control valve and less than the routing pressure of the second flow control valve.

6. The method of claim 5, further including the step of:

applying a third hydraulic pressure equal to or greater than the routing pressure of the second flow control valve operating the second flow control valve to a subsequent actuated position.

7. The method of claim 5, further including the steps of:

setting a valve base pressure for the first flow control valve, wherein the first flow control device is in the initial position when the hydraulic pressure in the control line is below the first valve's base pressure; and setting a valve base pressure for the second flow control valve, wherein the second flow control device is in the initial position when the hydraulic pressure in the control line is below the second valve's base pressure of the second flow control valve.

8. The method of claim 7, further including the step of:

applying a third hydraulic pressure equal to or greater than the routing pressure of the second flow control valve operating the second flow control valve to a subsequent actuated position.

9. A multi-drop flow control valve system, the system comprising:

a hydraulic control line;

a first hydraulically actuated flow control valve, set in an initial operating position, connected to the control line;

a routing valve connected between the control line and the first flow control valve, the routing valve operationally set at a first routing pressure;

a second hydraulically actuated flow control valve connected to the control line sequentially below the first hydraulically actuated flow control valve, the second hydraulically control valve being set in an initial operating position;

a routing valve connected between the control line and the second flow control valve, the routing valve being operationally set at a second routing pressure;

wherein a hydraulic pressure in the control line less than the first routing pressure will operate the first flow control valve to an actuated position, a hydraulic pressure equal to or greater than the first routing pressure will operate the first valve to a subsequent actuated position and operate the second flow control valve to an actuated position and a hydraulic pressure equal to or greater than the second routing pressure will operate the second flow control valve to a subsequent actuated position.

10. The system of claim 9, further including:

a first biasing mechanism maintaining the first flow control valve in its initial position when the hydraulic pressure in the control line is below a base pressure of the first biasing mechanism; and a second biasing mechanism maintaining the second flow control valve in its initial position when the hydraulic pressure in the control line is below a base pressure of the second biasing mechanism.

11. The system of claim 9, further including:

a third hydraulically actuated flow control valve set in an initial operational position connected sequentially below the first and the second flow control valves; and a routing valve connected between the control line and the third flow control valve, the routing valve being operationally set at a third routing pressure;

wherein a hydraulic pressure in the control line equal to or greater than the second routing pressure will operate the second flow control valve to a subsequent actuated position and operate the third flow control valve to an actuated position, and a hydraulic pressure equal to or greater that the third routing pressure will operate the third flow control valve to a subsequent actuated position.

12. The system of claim 9, wherein each of the hydraulically actuated flow control valves comprises a slidable sleeve.

13. The system of claim 9, wherein:

the initial position may be an open, closed, or choked position; and the actuated and the subsequent actuated positions may be an open, closed, or choked position.

14. The system of claim 9, wherein the hydraulically actuated flow control valves fail to the initial position.

15. A method for controlling multiple flow control valves with a single control line, the method comprising the steps of:

connecting a plurality of flow control valves sequentially to a single hydraulic control line;

setting each of the flow control valves in an initial operating position;

applying a first hydraulic pressure to operate each of the plurality of valves from its initial position to an actuated position; and applying a second hydraulic pressure operating each of the plurality of valves to a subsequent actuated positions.

16. The method of claim 15, further including the step of:

setting a valve base pressure for each of the plurality of flow control valves, wherein when hydraulic pressure is less than the base pressure the flow control valves are biased to the initial position.

17. A multi-drop flow control valve system, the system comprising:

a hydraulic control line;

a first hydraulically actuated flow control valve connected to the control line, the first hydraulically actuated flow control valve set in an initial operating position; and a second hydraulically actuated flow control valve sequentially connected to the control line, the second hydraulically actuated flow control valve set in an initial operating position;

wherein a first hydraulic pressure in the control line will operate the first and the second flow control valves to an actuated position and a second hydraulic pressure greater than the first hydraulic pressure will operate the first and the second flow control valves to subsequent actuated positions.

18. The system of claim 17, further including:

a first biasing mechanism maintaining the first flow control valve in its initial position when the hydraulic pressure in the control line is below a base pressure of the first biasing mechanism; and a second biasing mechanism maintaining the second flow control valve in its initial position when the hydraulic pressure in the control line is below a base pressure of the second biasing mechanism.

19. The system of claim 17, further including:

a third hydraulically actuated flow control valve connected sequentially below the first and the second flow control valves, the third hydraulically actuated flow control valve set in an initial operating position;

wherein a third hydraulic pressure in the control line greater than the second hydraulic pressure operates the first, second, and third flow control valves to subsequent actuated positions.

20. The system of claim 18, further including:

a third hydraulically actuated flow control valve connected sequentially below the first and the second flow control valves, the third hydraulically actuated flow control valve set in an initial operating position;

wherein a third hydraulic pressure in the control line greater than the second hydraulic pressure operates the first, second, and third flow control valves to subsequent actuated positions.

21. The system of claim 17, wherein each of the hydraulically actuated flow control valves comprises a slidable sleeve.

22. The system of claim 21, wherein when the valve is in an open position an orifice formed through the slidable sleeve is aligned with an aperture formed through a housing of the valve.

23. The system of claim 17, wherein:

the initial position may be an open, closed, or choked position; and the actuated and the subsequent actuated positions may be an open, closed, or choked position.

24. The system of claim 17, wherein the hydraulically actuated flow control valves fail to the initial position.

* * * * *